US006938976B2

(12) United States Patent
Siwinski et al.

(10) Patent No.: US 6,938,976 B2
(45) Date of Patent: Sep. 6, 2005

(54) PRINTER AND METHOD THEREFOR ADAPTED TO SENSE DATA UNIQUELY ASSOCIATED WITH A CONSUMABLE LOADED INTO THE PRINTER

(75) Inventors: Michael J. Siwinski, Rochester, NY (US); Scott C. Robinson, Rochester, NY (US); Robert W. Spurr, Rochester, NY (US); Timothy J. Tredwell, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 695 days.

(21) Appl. No.: 09/334,375

(22) Filed: Jun. 16, 1999

(65) Prior Publication Data

US 2002/0015066 A1 Feb. 7, 2002

(51) Int. Cl.[7] ..... B41J 29/393

(52) U.S. Cl. ..... 347/19; 347/23; 347/36; 347/50

(58) Field of Search ..... 347/5, 7, 14, 16, 347/19, 22, 23, 28, 36, 50, 86, 105; 271/3.01, 3.06, 3.09; 455/73; 340/10.1, 572.1; 399/12, 13, 24, 34, 35; 396/578

(56) References Cited

U.S. PATENT DOCUMENTS 3,580,565 A * 5/1971 Mallory ..... 271/158
3,713,148 A * 1/1973 Cardullo et al. ..... 342/42

(Continued)

FOREIGN PATENT DOCUMENTS

| | | | |
|---|---|---|---|
| AU | 1997 16071 B2 | | 1/1997 |
| AU | 712509 | | 11/1999 |
| EP | 0 257 789 A1 | | 3/1988 |
| EP | 0 500 277 B1 | | 8/1992 |
| EP | 0 575 772 B1 | | 4/1996 |
| EP | 0 595 549 B1 | | 9/1997 |
| EP | 0 979 736 A1 | | 2/2000 |
| EP | 1 045 279 A1 | | 10/2000 |
| FR | 2 744 391 | | 8/1997 |
| JP | 11-38559 | | 2/1999 |
| NL | 9400392 | | 3/1994 |
| WO | WO 92/00194 | | 1/1992 |
| WO | WO 96/08596 | | 3/1996 |
| WO | WO-9728001 A1 | * | 8/1997 |
| WO | 98 52762 | | 11/1998 |
| WO | WO 98/52762 | | 11/1998 |
| WO | 99/15336 | | 4/1999 |

OTHER PUBLICATIONS

Texas Instruments Inc., "Tag–it™ Inlays", Jan. 1999.
Texas Instruments Inc., "TIRIS for Automatic Recognition of Consumers", www.tiris.com.

(Continued)

*Primary Examiner*—Lamson Nguyen
*Assistant Examiner*—Blaise Mouttet
(74) *Attorney, Agent, or Firm*—Roland R. Schindler, II

(57) ABSTRACT

An inkjet printer adapted to sense type of supplied consumable receiver media, inks, printhead, and cleaning fluid. A transponder attached to a consumable is coupled to a memory device capable of storing information characteristic of the consumable. A transceiver is disposed within the inkjet printer, with antennae disposed for polling an individual transponder attached to each consumable. The transponder is capable of receiving a first RF frequency electromagnetic field from the transceiver and deriving power and address information from the first frequency, then generating a second RF frequency electromagnetic field in response, where the second electromagnetic field is characteristic of the data stored in memory. As instructed by a machine control logic processor, the transceiver can both read manufacturing data from the transponder about the consumable and write usage and processing data to the transponder for storage in memory. The transponder can also be coupled with a transducer for taking measurements from the consumable.

41 Claims, 3 Drawing Sheets

U.S. PATENT DOCUMENTS

| | | | | | |
|---|---|---|---|---|---|
| 4,857,893 | A | | 8/1989 | Carroll | 340/572.7 |
| 4,937,581 | A | | 6/1990 | Baldwin et al. | 340/10.52 |
| 5,266,968 | A | | 11/1993 | Stephenson | 347/172 |
| 5,266,975 | A | * | 11/1993 | Mochizuki et al. | 347/23 |
| 5,272,503 | A | | 12/1993 | LeSueur et al. | 399/25 |
| 5,347,274 | A | * | 9/1994 | Hassett | 340/988 |
| 5,349,401 | A | | 9/1994 | Bryant | 396/311 |
| 5,365,312 | A | | 11/1994 | Hillmann et al. | 399/12 |
| 5,428,659 | A | | 6/1995 | Renner et al. | 378/162 |
| 5,455,617 | A | | 10/1995 | Stephenson et al. | 347/214 |
| 5,587,752 | A | | 12/1996 | Petruchik | 396/315 |
| 5,699,091 | A | * | 12/1997 | Bullock et al. | 347/19 |
| 5,710,617 | A | | 1/1998 | Inuiya | 355/32 |
| 5,812,156 | A | | 9/1998 | Bullock et al. | 347/19 |
| 6,106,166 | A | * | 8/2000 | Spurr et al. | 396/578 |
| 6,227,643 | B1 | * | 5/2001 | Purcell et al. | 347/19 |
| 6,312,106 | B1 | * | 11/2001 | Walker | 347/50 |
| 6,381,416 | B2 | | 4/2002 | Manico et al. | 396/207 |

OTHER PUBLICATIONS

Texas Instruments Inc., "Description of Multipage, Selective Addressable & Selective Addressable (Secured) Transponders", Aug. 23, 1996, General Reference Manual.

Texas Instruments Inc., "An Industry Roundtable hosted by Texas Instruments at NACS–Tech '98", 1998, www.ti.com/mc/tiris.

Texas Instruments Inc., "TIRIS Automatic Recognition of Consumers: Series 5000 Reader System", 1999, pp. 1–14.

Texas Instruments Inc., "Micro–reader, RI–STU–MRD1", Jul. 25, 1996, Reference manual.

* cited by examiner

PRINTER AND METHOD THEREFOR ADAPTED TO SENSE DATA UNIQUELY ASSOCIATED WITH A CONSUMABLE LOADED INTO THE PRINTER

FIELD OF THE INVENTION

This invention generally relates to printers and printer methods and more particularly relates to a printer and method therefor adapted to sense data uniquely associated with a consumable loaded into the printer.

BACKGROUND OF THE INVENTION

An exemplary type of printer is an inkjet printer. In this regard, as inkjet printing technology increasingly achieves higher performance standards, inkjet printers are becoming more widely used for high-quality imaging, particularly in graphic arts applications, color printing, and proofing. In comparison with inexpensive "desktop" color printing applications, high-quality imaging applications require considerably more control over printing factors such as dot registration, dot size, ink density, color gamut and overall repeatability. Among digital color prepress systems, the "REALIST"™ printer (manufactured by IRIS Graphics, Inc., located in Bedford, Mass.) and the "SILVER REED"™ printer (manufactured by Silver Seiko Ltd., located in Tokyo, Japan) exemplify printers that achieve high-quality imaging using inkjet technology.

To serve the needs of this high-quality imaging market, manufacturers of inkjet printers and suppliers of consumable components, head-cleaning chemicals, inks, and receiver media manufacture these systems and consumables to exacting standards. Consumable inks used in these applications are tested to provide sensitometric performance within tight tolerances. Consumable receiver media (such as paper, film, textiles, and other substrates) are expected to be manufactured within a narrow range of variability for color, thickness, coating, and other characteristics. Printheads, which may be considered disposable (therefore considered as "consumable") with some systems, are precision-fabricated to provide repeatable performance, print to print. The need for high quality forces manufacturers of inkjet consumables to test and market consumable products that, in part, compensate for variability allowed with other consumables. This drives up the cost of consumables and increases the overall cost of operation to the owner of the inkjet printer.

To maintain high quality standards, consumables manufacturers routinely test and certify their products for performance within a required range. Consumable inks, for example, are characterized sensitometrically to provide repeatable response within a controlled color space. Inks may be differently formulated based on dye or pigment quality, intended use, or variable manufacturing conditions. While manufacturers collect and store this type of detailed consumables information, such information is not generally available to the end user or to the inkjet printing system itself. If such information were available, it could be used by control logic within the inkjet printer to optimize processing and printing and improve the overall level of imaging performance achieved by the inkjet printer. And if detailed information from manufacture were available on each type of consumable loaded in the printer, a control program on the printer could compensate for combinations of consumables, allowing the printer to adjust its imaging parameters accordingly.

Conventional inkjet printers have been adapted to identify the types of ink and paper loaded. U.S. Pat. No. 5,812,156 (Bullock, et al.) discloses use of a memory IC integrated into an ink cartridge or printhead and used to store usage information and data regarding variables such as ink type, manufacture date and batch, and performance. Here, a separate electrical connector is disclosed for making connection with memory circuitry when the ink cartridge is inserted into the printer. However, the requirement for electrical connection to the inkjet cartridge places demands not only on the design of the cartridge itself, but also on the design of the printer, because a corresponding connector must be provided to mate with the connector on the ink cartridge. Over time, electrical contacts that require regular connection and disconnection, such as occurs when an expended ink cartridge is removed and a new one inserted, provide a potential source for problems. Electrical contacts are known to break, collect dirt, corrode, or become misaligned, for example. This type of design solution may be workable with a low-volume desktop inkjet printer that employs a cartridge-based ink supply. However, large-capacity inkjet printers such as the "REALIST"™ and "SILVER REED"™ printers noted hereinabove use ink supplied from bottles, where direct electrical connection to the ink source is not easily provided.

U.S. Pat. No. 5,365,312 (Hillman, et al.) also discloses use of a memory associated with an ink reservoir for an inkjet printer. Here again, the solution disclosed requires an electrical connection with the memory component, which requires redesign of conventional ink bottle packaging to include a memory chip and a connector.

For use with such large-capacity printers, it would be beneficial to provide memory integrally attached to the ink consumable, where the memory could then be used to store manufacturing, performance, and usage information. It would be especially advantageous if redesign of packaging and addition of a separate connector were not required.

International patent WO 98/52762 (Purcell, et al.) discloses an inkjet printer in which memory circuits are disposed within ink and paper consumables, including memory connected with an RF transponder that is attached to a roll of paper media. Contactless communication, using an RF transceiver built into the inkjet printer, provides added advantages in situations where it would be difficult to maintain physical electrical contact with a rotating paper roll during operation.

In addition to consumable inks and paper used directly for imaging, a large-format inkjet printer may also include consumable fluid for printhead cleaning. A printhead in such a printer can be used with different types of ink and, correspondingly, can require different cleaning fluid formulations. Memory attached to the cleaning fluid consumable can be used to identify the formulation of the cleaning fluid consumable and to store usage information. Such information could also be used by the printer to make sure that the proper cleaning fluid is installed for the ink currently being used. In addition, because these fluids may include solvents or chemicals that might require collection and return to a disposal facility after use, it would be beneficial to identify the specific formulation of waste cleaning fluid collected in a waste bottle or other container. This same advantage would apply for waste inks, in systems that employ a "continuous-flow" output, in which unneeded droplets of ink are deflected to a waste container.

In the memory solutions disclosed above, usage data is currently obtained by counting. In the simplest implementations, printer logic counts the number of prints generated and stores these values in memory to maintain a rough estimate of consumables usage. Or, printer logic directly counts the number of ink droplets expelled from a specific ink reservoir. Tracking usage in this manner has some inherent disadvantages, because some type of averaging and estimation must be used. Moreover, for cleaning fluid consumables, a counting method of this type could only provide a gross estimation of usage and of fluid remaining. It would be advantageous if a consumable device had a built-in sensing mechanism that, acting in cooperation with integrally connected memory components, accurately indicated the amount of a consumable used or remaining. Conventional sensing methods include mechanical level-sensing, but do not integrally couple level-sensing with attached memory components.

A printhead may be used with specific inks or with specific receiver media and, in some inkjet printers, is considered a consumable item. There may be instances where usage data stored with the printhead is useful for maintaining reliable printer operation. Previously mentioned U.S. Pat. No. 5,812,156 also discloses a memory circuit attached to a removable printhead. Electrical contacts to the memory circuit are provided in the printhead interface to the printer. This allows identification of printhead type, provided that the printhead is installed in the printer apparatus.

In an inkjet printer, the ability of control logic to access detailed information on consumable receiver media, inks, and cleaning fluids, and on the printing hardware itself, helps to optimize the writing process and provides tools for maximizing image quality. Thus it can be seen that there is a need for an inkjet printer that is adapted to sense types of consumable receiver media, inks, cleaning chemicals, and printhead. The capability of the printer to perform this type of sensing without making physical contact with the consumable package would present cost, ease of use and reliability advantages.

SUMMARY OF THE INVENTION

It is an object of the present invention to provide a printer and method therefor adapted to sense data uniquely associated with a consumable loaded into the printer.

With this object in view, the present invention resides in a printer adapted to sense data uniquely associated with a consumable loaded therein, comprising a transceiver for transmitting a first electromagnetic field and for sensing a second electromagnetic field; a transponder coupled to said consumable, said transponder adapted to receive the first electromagnetic field and generate a second electromagnetic field in response to the first electromagnetic field received thereby; and a memory coupled to said transponder, said memory having the data stored therein uniquely associated with the consumable, whereby the second electromagnetic field caries the data stored in said memory while the second electromagnetic field is generated, so that the second electromagnetic field is characteristic of the data stored in said memory.

According to an aspect of the present invention, an inkjet printer includes an ink supply reservoir which is adapted to provide information about the ink included therein by means of a non-volatile semiconductor memory component that is integrally contained in a transponder. The memory component may be, for example, an EEPROM (Electrically Erasable Programmable Read-Only Memory). Stored in the memory component are encoded data indicative of manufacture and performance attributes of the ink. Similarly, a receiver media supply is loaded into the inkjet printer, with a memory integrally contained in a transponder attached to the receiver media supply. A cleaning fluid and waste container are each adapted for non-volatile memory storage in a similar fashion, each having a memory integrally attached to a transponder. Each transponder is capable of receiving a first electromagnetic field generated by a radio-frequency transceiver unit. Each transponder provides power to its semiconductor circuitry as the transponder receives the first electromagnetic field. When the transponder circuitry is powered, the component generates a second electromagnetic field in response to the first electromagnetic field. The second electromagnetic field contains data about the consumable item. The radio frequency transceiver unit senses the second electromagnetic field and extracts the data content for subsequent processing by a control logic processing unit that operates the inkjet printer.

A feature of the present invention is the provision of a radio frequency transceiver capable of transmitting a first electromagnetic field to be intercepted by a transponder having data stored therein indicative of the consumable, the transponder capable of generating a second electromagnetic field to be sensed by the radio frequency transceiver.

A further feature of the present invention is the ability of the radio frequency transceiver to address a specific transponder component and to write data to that component, where the data written is indicative of usage of a consumable.

It is an advantage of the present invention that it obviates the need for manual entry of data describing an inkjet consumable. Instead, the invention provides information to the operator or to the inkjet printer apparatus itself about a consumable that is loaded in the printer.

It is a further advantage of the present invention that it allows control logic in an inkjet printer to determine the type of consumable that is loaded and to access related data about the consumable, such as manufacturing date, batch number, and chemical type, and, in turn, to record on the memory circuitry that is provided with that consumable useful data on usage and other processing information.

It is a further advantage of the present invention that it provides a contactless communication interface, accessing data without requiring that electrical contact be made to corresponding contacts mounted on consumable packaging.

It is a further advantage of the present invention that it allows backward-compatibility with existing packaging designs for consumables. That is, consumables provided with transponder components can be used in older inkjet printers that may not be equipped with the necessary transceiver and logic circuitry that enable use and management of consumables data. No substantial alteration of external packaging is necessary to implement this invention.

It is a further advantage of the present invention that it allows calibration data, sensitometry data, and other detailed performance information about the consumable to be stored and provided as part of the consumables packaging, so that detailed information is integrally attached to the consumable. Thus, should a consumable item be moved from one inkjet printer to another, for example, usage information is retained.

It is a further advantage of the present invention that it provides a method for measuring and storing consumable levels, where this method is not dependent on a print count with its inherent inaccuracies.

It is a further advantage of the present invention that it allows an inkjet printer to adapt to interacting consumables loaded therein, so that, for example, consumable receiver media from a known batch can be printed upon optimally when used with consumable inks from a known batch. Or, printer operation could be temporarily disabled if the type of ink loaded is not compatible for a specific printhead or if a printhead cleaning fluid must be changed in order to suit a specific ink type.

It is yet a further advantage of the present invention that it provides a memory coupled to a waste fluid container, allowing automated identification of fluid composition as an aid to environmentally acceptable disposal of the waste fluid.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

For the description that follows, the general term "consumable" is used to include the following items that may be loaded or installed in an inkjet printer:

(1) Receiver media, the substrate on which the viewable image is printed (for example, paper, cardboard, film, textile, vinyl);

(2) Ink, typically provided in the four process colors, cyan, magenta, yellow, and black, with the possible addition of other colors;

(3) Cleaning fluid, used to cleanse the printhead, which fluid may be collected after use in a waste container stored within the printer; and (4) Printhead, where the user is required to replace the printhead or to interchange printheads based on the ink or receiver media in use.

Figure 1:
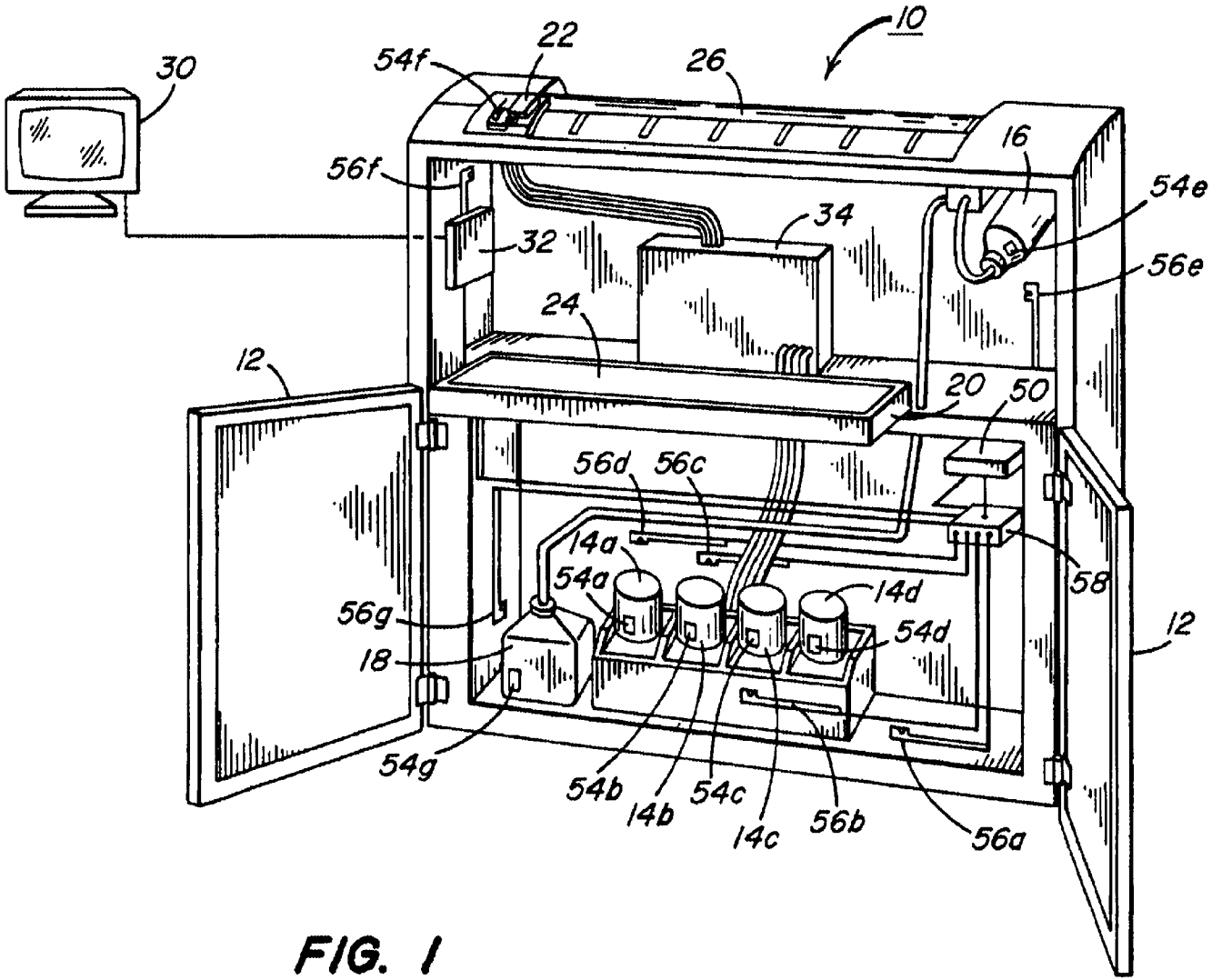
FIG. 1 is a perspective view of an inkjet printer adapted to sense consumables, with a panel opened to show location of consumable fluids.

FIG. 1 shows a high-quality inkjet printer, generally referred to as 10, that has been adapted to sense data uniquely associated with consumables loaded therein. Hinged front panels 12 are shown opened in FIG. 1 to provide a view of ink reservoirs 14*a/b/c/d*, a cleaning fluid bottle 16, and a waste bottle 18. Paper 24 is loaded in individual sheets from a tray 20. A printhead 22, supplied with ink by a pumping assembly 34, writes the image to paper 24 which is pulled out from tray 20 and loaded onto an imaging drum 26. A control console 30 which serves as, a separate computer connected to inkjet printer 10, is used to monitor and control inkjet printer 10 operation. Control console 30 performs operations such as file transfer and job queuing, and displaying maintenance and error messages. A computer program running on control console 30 performs the logic control processing functions of the printer, providing operating instructions to a machine control processor 32, which is a microprocessor-based controller that runs what is commonly-known in the art as "low-level" processes of inkjet printer 10.

Figure 2:
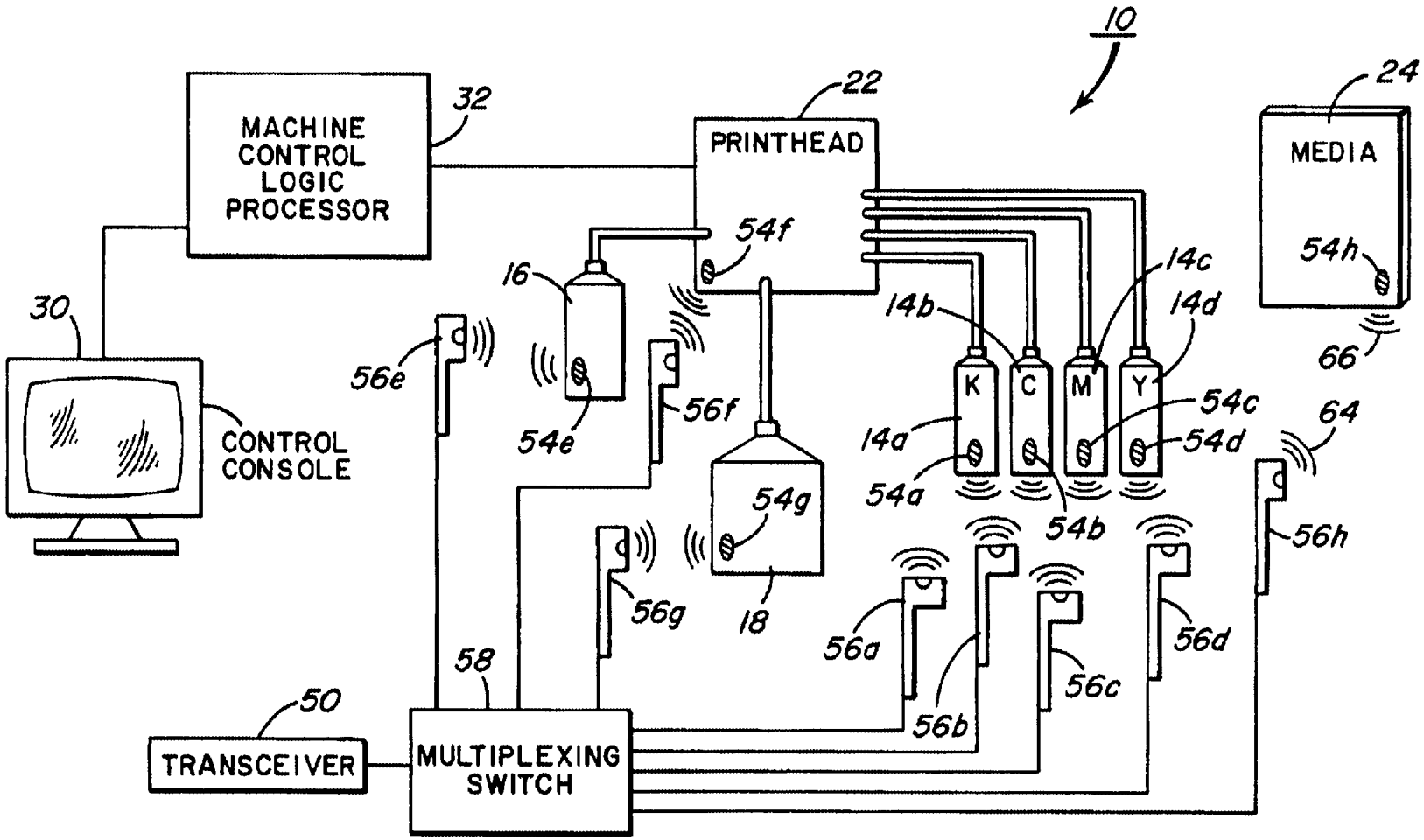
FIG. 2 is a schematic diagram showing functional relationships of components within an inkjet printer that has been adapted to sense its loaded consumables.

FIGS. 1 and 2 show hardware components that adapt inkjet printer 10 for sensing consumable ink in ink reservoir 14*a/b/c/d*. An RF (Radio Frequency) transceiver 50 is connected, via a multiplexing switch 58, to antennae 56*a/b/c/d/e/f/g/h*. Multiplexing switch 58 allows transceiver 50 to communicate independently with multiple antennae, but limits communication of transceiver 50 to one antenna 56*a/b/c/d/e/f/g/h* at a time. A transponder 54*a/b/c/d/e/f/g/h*, configured as described subsequently, is integrally attached to, or disposed within, ink reservoirs 14*a/b/c/d*, cleaning fluid bottle 16, printhead 22, waste bottle 18, and/or paper tray 20.

Referring again to FIG. 1, there may be many variations as to layout and placement of ink reservoirs 14*a/b/c/d*, cleaning fluid bottle 16, waste bottle 18, and paper supply. For example, paper media could alternately be supplied in roll form (as is the case, for example, with the "HP 755CM"™ printer from Hewlett-Packard Company, located in Palo Alto, Calif.). Cleaning fluid is not required for all printhead 22 types. Also, ink reservoirs 14*a/b/c/d* may be supplied in a number of different forms.

FIG. 2 shows, in schematic form, how the present invention provides sensing of consumables within inkjet printer 10. An RF transceiver 50 is connected to machine control processor 32 internal to apparatus 10. Such a transceiver 50 may be a "Model S2000" transceiver, available from Texas Instruments, Incorporated, located in Dallas, Tex., USA. Alternatively, transceiver 50 may use a "Model U2270B "™ transceiver, available from Vishay-Telefunken Semiconductors, Incorporated, located in Malvern, Pa., USA. Transceiver 50 connects, via a multiplexing switch 58, to antenna 56*a/b/c/d/e/f/g/h* located at each of a plurality of locations, with one antenna 56*a/b/c/d/e/f/g/h* respectively associated with the consumable items to be sensed.

In operation, transceiver 50 is capable of transmitting a first electromagnetic field 64 of a first predetermined frequency, for reasons disclosed presently. Transceiver 50 is also capable of receiving a second electromagnetic field 66 of a second predetermined frequency, for reasons disclosed presently. Typically, the same frequency serves for both first and second electromagnetic fields 64 and 66.

An RF transponder 54*a/b/c/d/e/f/g/h* is integrally connected to each consumable item, as part of the consumable package. Each transponder 54*a/b/c/d/e/f/g/h* can be an "SAMPT" (Selective Addressable Multi-Page Transponder), part number "RI-TRP-IR2B" available from Texas Instruments, Incorporated. Alternately, each transponder 54*a/b/c/d/e/f/g/h* may be a "Model TL5550"™ transponder, available from Vishay-Telefunken Semiconductors, Incorporated. Especially advantageous for attachment to consumable paper or film, a low-profile device such as a "TAG-IT™ Inlay" available from Texas Instruments, Incorporated could alternately be used for transponder 54*a/b/c/d/e/f/g/h*.

RF transponders 54*a/b/c/d/e/f/g/h* are preferably low-power devices that derive their source power from the first electromagnetic field 64 emitted by transceiver 50. By way of example only, and not by way of limitation, transponders 54*a/b/c/d/e/f/g/h* are generally cylindrical, smaller than 4 mm in diameter and less than 32 mm in length. This allows transponders 54*a/b/c/d/e/f/g/h* to be compact and thus easily attached to consumables.

As FIG. 2 illustrates, transceiver 50 communicates, via a separate antenna 56*a/b/c/d/e/f/g/h*, with each of transponders 54*a/b/c/d/e/f/g/h*. Transceiver 50 polls a single transponder 54*a/b/c/d/e/f/g/h* at a time using any one of a number of possible multiplexing schemes. In the preferred embodiment, multiplexing switch 58, using techniques and components well-known in the art, makes the electrical connection between a specific antenna 56*a*, 56*b*, 56*c*, 56*d*, 56*e*, 56*f*, 56*g*, or 56*h* and transceiver 50 in order to poll a corresponding transponder 54*a*, 54*b*, 54*c*, 54*d*, 54*e*, 54*f*, 54*g*, or 54*h*. Alternate mechanisms for polling individual transponders 54*a*, 54*b*, 54*c*, 54*d*, 54*e*, 54*f*, 54*g*, or 54*h* include use of a plurality of microreader modules, such as a "RI-STU-MRD1 Micro-reader"™ available from Texas Instruments, Incorporated. Using this scheme, a microreader module, connected to machine control processor 32, would be disposed within apparatus 10 near the location of each transponder 54*a/b/c/d/e/f/g/h*.

Yet another alternative polling technique employs a "non-collision" algorithm for communicating with multiple transponders grouped in a confined area. Briefly, this algorithm works using a loop that proceeds in steps to increase transceiver 50 RF output power from an initial low value as transceiver 50 repeatedly polls for a transponder 54*a*, 54*b*, 54*c*, 54*d*, 54*e*, 54*f*, 54*g*, or 54*h*. As soon as it detects a transponder 54*a*, 54*b*, 54*c*, 54*d*, 54*e*, 54*f*, 54*g*, or 54*h*, transceiver 50 communicates with the transponder 54*a*, 54*b*, 54*c*, 54*d*, 54*e*, 54*f*, 54*g*, or 54*h*, then temporarily disables the transponder 54*a*, 54*b*, 54*c*, 54*d*, 54*e*, 54*f*, 54*g*, or 54*h*. Transceiver 50 then repeats polling, incrementing its RF output power level slightly with each polling operation, to locate, communicate with, and then temporarily disable the next available transponder 54*a*, 54*b*, 54*c*, 54*d*, 54*e*, 54*f*, 54*g*, or 54*h*. In this way, transceiver 50 communicates with multiple transponders 54*a/b/c/d/e/f/g/h* in order of their return signal strength, until all transponders 54*a/b/c/d/e/f/g/h* have been polled.

Transceiver 50 is electrically coupled to machine control processor 32, by means of a standard interface (such as, for example, RS-232C serial connection). This connection, in conjunction with any of the polling mechanisms described above, allows machine control processor 32 to control the operation of transceiver 50 so that it can successively poll individual transponders 54*a/b/c/d/e/f/g/h* that correspond to each consumable that is currently loaded in inkjet printer 10, in order to access information from each transponder 54*a/b/c/d/e/f/g/h*.

As FIG. 2 shows, communication via antenna 56*a/b/c/d/e/f/g/h* between transceiver 50 and transponders 54*a/b/c/d/e/f/g/h* can take place over a relatively limited distance (e.g., about 3 feet or 91.44 centimeters). This allows transceiver 50 to be mounted or placed within inkjet printer 10 at a convenient location, allowing retrofit of transceiver 50, along with multiplexing switch 58 and antennas 56*a/b/c/d/e/f/g/h*. This, of course, allows upgrading of existing equipment.

It is instructive to note how transceiver 50 communicates with transponder 54*a/b/c/d/e/f/g/h*, which are disposed at a locations within inkjet printer 10. Transponder 54*a/b/c/d/e/f/g/h* is tuned to the RF carrier frequency emitted by transceiver 50. Upon receiving an initial RF signal from transceiver 50, transponder 54*a/b/c/d/e/f/g/h* circuitry obtains, from the emitted electromagnetic energy, sufficient energy to provide source voltage for its internal circuitry. Thus, no battery is needed to separately power transponder 54*a/b/c/d/e/f/g/h*.

Each transponder 54*a/b/c/d/e/f/g/h* is individually programmed with an unique identifying address code (ID). As a final stage in manufacture, transponder 54*a/b/c/d/e/f/g/h* is programmed to store its ID along with other data that is characteristic of the consumable. In the preferred embodiment, transponder 54*a/b/c/d/e/f/g/h* is assembled with the consumable, but does not require programming until final assembly. This obviates the need to track a consumable with its corresponding transponder 54*a/b/c/d/e/f/g/h* during manufacture.

Figure 3:
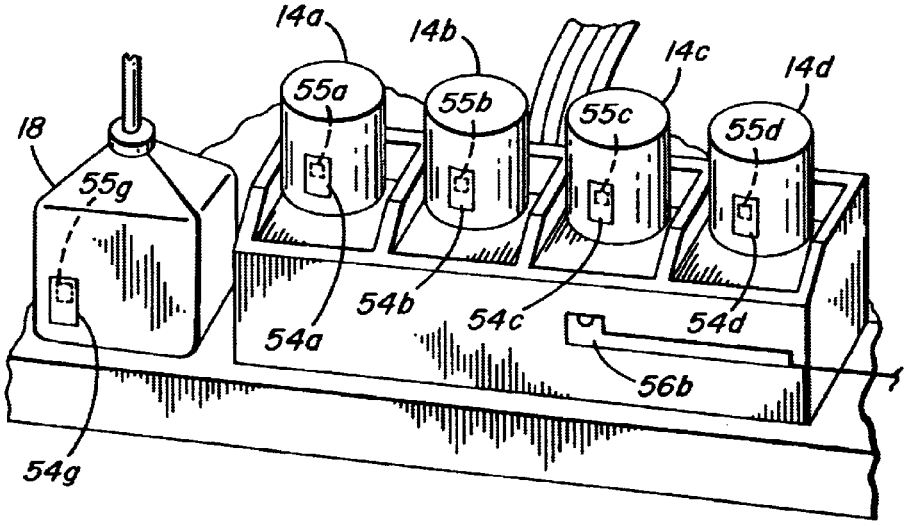
FIG. 3 is a view in perspective of a cutaway of FIG. 1.

Referring to FIGS. 2 and 3, transceiver 50 has both read and write access to transponder 54*a/b/c/d/e/f/g/h* memory data, which is stored in a plurality of memories 55*a/b/c/d/e/f/g/h* coupled to respective ones of the transponders. For sake of clarity, only memories 55*a/b/c/d/g* are shown, it being understood that memories 55*e/f/h* are also present and coupled to their respective transponders 54*e/f/h*. As will be described subsequently, this allows transponder 54*a/b/c/d/e/f/g/h* to store useful information on actual usage in addition to its stored information on manufacture.

To communicate with an individual transponder 54*a/b/c/d/e/f/g/h*, transceiver 50 encodes the unique identifying address code as part of its emitted signal, along with a command to read data from or to write data to (i.e., "program") transponder 54*a/b/c/d/e/f/g/h*. Transponder 54*a/b/c/d/e/f/g/h* responds to transceiver 50 communication only when it has been addressed correctly. This mechanism allows transceiver 50 to specifically address an individual transponder 54*a*, 54*b*, 54*c*, 54*d*, 54*e*, 54*f*, 54*g*, or 54*h*, and helps to avoid interference signals from a nearby transponder 54*a*, 54*b*, 54*c*, 54*d*, 54*e*, 54*f*, 54*g*, or 54*h* that might be unintentionally activated by the received signal from transceiver 50.

In addition to selective addressing, there are other data security options available with the SAMPT device used for transponder 54*a/b/c/d/e/f/g/h*. Individual memory blocks or "pages" can be separately locked to prevent inadvertent overwriting of stored data. Commands are available to allow access to individual pages only, so that transceiver 50 can be permitted to read or write only specific data from transponder 54*a/b/c/d/e/f/g/h*.

Consumable receiver media, inks, and cleaning fluids are adapted for sensing by attachment of a transponder 54*a/b/c/d/e/f/g/h* to the consumables packaging. For consumable fluids, the following are exemplary methods for transponder attachment:

(a) Attachment to the outside of the consumables package. In the preferred embodiment, transponder 54*a/b/c/d* is attached to the outside surface of ink reservoir 14*a/b/c/d*. Glue or adhesive tape, for example, holds transponder 54*a/b/c/d* in place. Similarly, transponder 54*e* is attached to the outside surface of cleaning fluid bottle 16 and transponder 54*g* is attached to the outside surface of waste bottle 18.

(b) Insertion within the consumables package. In an alternate embodiment, transponder 54*a/b/c/d* is disposed within ink reservoir 14*a/b/c/d*. Sealed within a plastic capsule, transponder 54*a/b/c/d* is protected from contact with the ink fluid and is able to communicate with transceiver 50, since transponder 54*a/b/c/d* will lie on the bottom of ink reservoir 14*a/b/c/d*. Similarly, transponder 54*e* can be inserted inside cleaning fluid bottle 16 and transponder 54*g* can be inserted inside waste bottle 18.

For paper 24 in roll form, transponder 54*h* can be attached to or inserted within the core that holds the paper roll. For paper in sheet form (used to load a paper tray), a separate loading sheet can be provided with the paper 24 package, where the loading sheet includes an attached transponder 54*h*. Or, each sheet of paper 24 can include an attached transponder 54*h*, using a miniaturized transponder 54*h*. Similarly, other media could include a transponder attached to packaging or to the substrate material itself. Another transponder 54*f* is attached to printhead 22, in a suitable position that does not hinder printhead 22 installation or operation.

By way of example only and not by way of limitation, the data stored in transponder 54*a/b/c/d* that is attached to ink reservoir 14*a/b/c/d* may be any of the exemplary data displayed in Table 1 hereinbelow.

TABLE 1

Data Stored in Transponder 54a/b/c/d for Ink Reservoir 14a/b/c/d

| Data Stored | Number of Bits | Description |
|---|---|---|
| Consumable Type Identifier | 8 | An 8-bit number encoding the type of ink consumable. |
| Product Code | 40 | 10-digit product code. (May not be required if Consumable Type Identifier provides enough data.) |
| Catalog Number | 32 | For example, C349. |
| Manufacture Date | 16 | 16-bit encoded date. Includes 4-bit month, 5-bit day, 7-bit year components. |
| Ink Properties | 256 | Encoded data giving surface tension, solvent concentration, colorant usage, binder and additive usage, data on chemical composition and absorption properties. |
| Sensitometric Data | 128 | Encoded parameter values allowing characterization of sensitometric response for this ink, including gamut-mapping coordinates, density values. |
| Usage Level | 32 | 32-bit value indicating level or usage data for contents of this ink reservoir 14a/b/c/d. |

As Table 1 shows, data included in transponder 54*a/b/c/d* for an ink consumable include both data from manufacture (written to memory at the factory) and data from usage (written to memory and updated based on number of prints created).

By way of example only and not by way of limitation, the data stored in transponder 54*f* that is attached to printhead 22 may be any of the exemplary data displayed in Table 2 hereinbelow.

TABLE 2

Data Stored in Transponder 54f for Printhead 22

| Data Stored | Number of Bits | Description |
|---|---|---|
| Consumable Type Identifier | 8 | An 8-bit number encoding the type of printhead 22. |
| Product Code | 40 | 10-digit product code. (May not be required if Consumable Type Identifier provides enough data.) |
| Catalog Number | 32 | For example, PH33. |
| Manufacture Date | 16 | 16-bit encoded date. Includes 4-bit month, 5-bit day, 7-bit year components. |

TABLE 2-continued

Data Stored in Transponder 54f for Printhead 22

| Data Stored | Number of Bits | Description |
|---|---|---|
| Printhead Properties | 128 | Encoded data giving printhead 22 type. |
| Usage Counter | 32 | 32-bit counter recording usage data for printhead 22. |

By way of example only and not by way of limitation, the data stored in transponder 54*h* that is attached to paper 24 may be any of the exemplary data displayed in Table 3 hereinbelow.

TABLE 3

Data Stored in Transponder 54h for Paper 24

| Data Stored | Number of Bits | Description |
|---|---|---|
| Consumable Type Identifier | 8 | An 8-bit number encoding the type of paper 24. |
| Product Code | 40 | 10-digit product code. (May not be required if Consumable Type Identifier provides enough data.) |
| Catalog Number | 32 | For example, W558. |
| Manufacture Date | 16 | 16-bit encoded date. Includes 4-bit month, 5-bit day, 7-bit year components. |
| Paper Properties | 256 | Encoded data giving coatings type, absorption rate, density value, light-fastness rating, paper composition (barrier/receiver/base layers). |
| Usage Counter | 32 | 32-bit counter recording usage data for paper 24. |

By way of example only and not by way of limitation, the data stored in transponder 54*e* that is attached to cleaning fluid bottle 16 may be any of the exemplary data displayed in Table 4 hereinbelow.

TABLE 4

Data Stored in Transponder 54e for Cleaning fluid Bottle 16

| Data Stored | Number of Bits | Description |
|---|---|---|
| Consumable Type Identifier | 8 | An 8-bit number encoding the type of cleaning fluid. |
| Product Code | 40 | 10-digit product code. (May not be required if Consumable Type Identifier provides enough data.) |
| Catalog Number | 32 | For example, CL6O. |
| Manufacture Date | 16 | 16-bit encoded date. Includes 4-bit month, 5-bit day, 7-bit year components. |
| Solution Properties | 128 | Encoded data giving solution type, solvent formulation, volatility data. |
| Usage Level | 32 | 32-bit value indicating usage level data for cleaning fluid bottle 16. |

By way of example only and not by way of limitation, the data stored in transponder 54*g* that is attached to waste bottle 18 may be any of the exemplary data displayed in Table 5 hereinbelow.

TABLE 5

Data Stored in Transponder 54g for Waste Bottle 18

| Data Stored | Number of Bits | Description |
|---|---|---|
| Consumable Type Identifier | 8 | An 8-bit number encoding the type of cleaning fluid included in waste bottle 18. |
| Product Code | 40 | 10-digit product code. (May not be required if Consumable Type Identifier provides enough data.) |
| Level | 32 | 32-bit value indicating relative level of fluid in waste bottle 18. |

Among its functions, machine control logic processor 32 runs a program that controls various aspects of the print operation. Variables under control of this program include, for example, writing speed, drying time, and ink dot size. In order to determine how to adjust these operating variables, machine control logic processor 32 accesses stored information from the memory associated with each consumable before beginning a print job. Machine control logic processor 32 then uses the accessed information to alter the way it processes the print job, based on a stored program.

When a new consumable is first loaded in inkjet printer 10, an initial identification sequence takes place, during which transponder 54*a/b/c/d/e/f/g/h* on the newly loaded consumable is initially read and its data stored by machine control processor 32. This sequence can be operator-initiated, such as by entry of a command on control console 30. Alternately, consumable initialization can be initiated by sensing a mechanical event (such as the closing of front panel 12 on inkjet printer 10.)

While the invention has been described with particular reference to its preferred embodiments, it will be understood by those skilled in the art that various changes may be made and equivalents may be substituted for elements in the preferred embodiments without departing from the scope of the invention. Therefore, what is provided is a printer and method therefor adapted to sense data uniquely associated with a consumable loaded into the printer.

Parts List

10. Inkjet printer
12. Front panel
14*a/b/c/d*. Ink reservoir
16. Cleaning fluid bottle
18. Waste bottle
20. Tray
22. Printhead
24. Paper
26. Imaging drum
30. Control console
32. Machine control logic processor
34. Pumping assembly
50. Transceiver
54*a/b/c/d/e/f/g/h* Transponders
55*a/b/c/d/e/f/g/h* Memories
56*a/b/c/d/e/f/g/h* Antennae
58. Multiplexing switch
64. First electromagnetic field
66. Second electromagnetic field

What is claimed is:

1. A printer of the type which selectively deposits a color marking material onto a receiver to form an image on the receiver, the printer being adapted to sense and update data uniquely associated with a cleaning fluid consumable loaded into the printer, comprising:

(a) a transceiver for transmitting a first electromagnetic field and for sensing a second electromagnetic field, the first electromagnetic field containing data for writing into a memory associated with the cleaning consumable;

(b) a transponder coupled to said cleaning fluid consumable, said transponder adapted to receive the first electromagnetic field and generate the second electromagnetic field in response to the first electromagnetic field received thereby, the transponder adapted to receive energy from the first electromagnetic field that is generated by the transceiver and the energy comprising the only energy for powering the transponder and the transponder being adapted to read data from the memory and write updated data to the memory in accordance with an instruction code from the transceiver in the first electromagnetic field.

2. A printer of the type which selectively deposits a color marking material onto a receiver to form an image on the receiver, the printer being adapted to sense data uniquely associated with a printer consumable to be loaded into the printer, comprising:

(a) a transceiver for transmitting a first electromagnetic field and for sensing a second electromagnetic field;

(b) a first transponder including a first memory coupled to a first consumable used by the printer; and (c) a second transponder including a second memory coupled to a second consumable used by the printer, each of said first and second memories having data stored therein indicative of type of consumable, so that a selected one of either of said transponders is capable of receiving the first electromagnetic field and generating a second electromagnetic field in response to the first electromagnetic field received thereby, the second electromagnetic field being sensed by said transceiver and characteristic of the data stored in said memory, the data being associated with said selected transponder generating the second electromagnetic field; and wherein the transceiver is adapted to alternately communicate with the first and second transponders.

3. The printer of claim 2, wherein said first memory is coupled to a first consumable that is a receiver media consumable and wherein said second memory is coupled to a second consumable that is an ink consumable.

4. The printer of claim 2, wherein said first memory is coupled to a first consumable that is a printhead consumable and wherein said second memory is coupled to a second consumable that is an ink consumable.

5. The printer of claim 2, wherein said first memory is coupled to a first consumable that is an ink consumable and wherein said second memory is coupled to a second consumable that is a cleaning fluid consumable.

6. The printer of claim 2, wherein said first memory is coupled to a first consumable that is a print head consumable and wherein said second memory is coupled to a second consumable that is a cleaning fluid consumable.

7. The printer of claim 2, further comprising a third transponder including a third memory coupled to a third consumable, said third memory having data stored therein indicative of type of consumable.

8. The printer of claim 7, wherein said first memory is coupled to a first consumable that is a receiver media consumable, wherein said second memory is coupled to a second consumable that is a print head consumable and wherein said third memory is coupled to a third consumable that is a cleaning fluid consumable.

9. The printer of claim 7, wherein said first memory is coupled to a first consumable that is a printhead consumable, wherein said second memory is coupled to a second consumable that is an ink consumable and wherein said third memory is coupled to a third consumable that is a cleaning fluid consumable.

10. The printer of claim 7, wherein the first memory is coupled to a first consumable that is a printhead consumable, wherein the second memory is coupled to a second consumable that is an ink consumable and wherein the third memory is coupled to a third consumable that is a receiver media consumable.

11. The printer of claim 7, further comprising a fourth transponder including a fourth memory coupled to a fourth consumable, said fourth memory having data stored therein indicative of type of consumable.

12. The printer of claim 11, wherein said first memory is coupled to a first consumable that is a printhead consumable, wherein said second memory is coupled to a second consumable that is an ink consumable, wherein said third memory is coupled to a third consumable that is a receiver media consumable and wherein said fourth memory is coupled to a fourth consumable that is a cleaning fluid consumable.

13. In a printer which operates to selectively deposit a color marking material onto a receiver to form an image on the receiver, a method of sensing data uniquely associated with a printer consumable loaded into the printer, the method comprising the steps of:

(a) providing a transceiver for transmitting a first electromagnetic field and for sensing a second electromagnetic field;

(b) providing a first transponder including a first memory coupled to a first consumable; and (c) providing a second transponder including a second memory coupled to a second consumable, each of the first and second memories having data stored therein indicative of type of consumable, the transceiver polling the respective transponders so that each of the transponders is responsive to a respective first electromagnetic field emitted by the transceiver and each transponder generates a second electromagnetic field in response to the respective first electromagnetic field received thereby, the second electromagnetic field being sensed by the transceiver and characteristic of the data stored in the respective memory, the data being associated with the selected transponder generating the second electromagnetic field.

14. The method of claim 13, wherein the step of providing a first transponder comprises the step of providing a first transponder including a first memory coupled to a first consumable that is a receiver media consumable and wherein the step of providing a second transponder comprises the step of providing a second transponder including a second memory coupled to a second consumable that is an ink consumable.

15. The method of claim 13, wherein the step of providing a first transponder comprises the step of providing a first transponder including a first memory coupled to a first consumable that is a printhead consumable and wherein the step of providing a second transponder comprises the step of providing a second transponder including a second memory coupled to a second consumable that is an ink consumable.

16. The method of claim 13, wherein the step of providing a first transponder comprises the step of providing a first transponder including a first memory coupled to a first consumable that is an ink consumable and wherein the step of providing a second transponder comprises the step of providing a second transponder including a second memory coupled to a second consumable that is cleaning fluid consumable.

17. The method of claim 13, wherein the step of providing a first transponder comprises the step of providing a first transponder including a first memory coupled to a first consumable that is a print head consumable and wherein the step of providing a second transponder comprises the step of providing a second transponder including a second memory coupled to a second consumable that is a cleaning fluid consumable.

18. The method of claim 13, further comprising the step of coupling a third transponder including a third memory coupled to a third consumable, the third memory having data stored therein indicative of type of consumable.

19. The method of claim 18, wherein the step of providing a first transponder comprises the step of providing a first transponder including a first memory coupled to a first consumable that is a receiver media consumable, wherein the step of providing a second transponder comprises the step of providing a second transponder including a second memory coupled to a second consumable that is a print head consumable and wherein the step of providing a third transponder comprises the step of providing a third transponder including a third memory coupled to a third consumable that is a cleaning fluid consumable.

20. The method of claim 18, wherein the step of providing a first transponder comprises the step of providing a first transponder including a first memory coupled to a first consumable that is a printhead consumable, wherein the step of providing a second transponder comprises the step of providing a second transponder including a second memory coupled to a second consumable that is an ink consumable and wherein the step of providing a third transponder comprises the step of providing a third transponder including a third memory coupled to a third consumable that is a cleaning fluid consumable.

21. The method of claim 18, wherein the step of providing a first transponder comprises the step of providing a first transponder including a first memory coupled to a first consumable that is a printhead consumable, wherein the step of providing a second transponder comprises the step of providing a second transponder including a second memory coupled to a second consumable that is an ink consumable and wherein the step of providing a third transponder comprises the step of providing a third transponder including a third memory coupled to a third consumable that is a receiver media consumable.

22. The method of claim 18, further comprising the step of providing a fourth transponder including a fourth memory coupled to a fourth consumable, the fourth memory having data stored therein indicative of type of consumable.

23. The method of claim 22, wherein the step of providing a first transponder comprises the step of providing a first transponder including a first memory coupled to a first consumable that is a printhead consumable, wherein the step of providing a second transponder comprises the step of providing a second transponder including a second memory coupled to a second consumable that is an ink consumable, wherein the step of providing a third transponder comprises the step of providing a third transponder including a third memory coupled to a third consumable that is a receiver media consumable and wherein the step of providing a fourth transponder comprises the step of providing a fourth transponder including a fourth memory coupled to a fourth consumable that is a cleaning fluid consumable.

24. In a printer which operates to selectively deposit ink onto a receiver to form an image on the receiver, a method for sensing data uniquely associated with an ink consumable loaded into the printer, the method comprising the steps of:

(a) operating a transceiver to transmit a first electromagnetic field, the first electromagnetic field including a code providing a command to read or write data; and (b) providing a transponder associated with the ink consumable, the transponder receiving the first electromagnetic field and generating a second electromagnetic field in response to the code in the first electromagnetic field providing a command to read data from a memory, the second electromagnetic field carrying information relative to data stored in the memory, the memory being coupled to the transponder and having the data stored therein and uniquely associated with the ink consumable, and the transponder in response to a code providing a command to write data provides a signal to the memory to apply information from the first electromagnetic field into the memory wherein the transponder receives energy from the first electromagnetic field as the only energy for powering the transponder and wherein the consumable is a container for storing a waste material and the memory provides information relative to identification of the material as an aid to environmentally acceptable disposal of the waste material.

25. In a printer which operates to selectively deposit a color marking material onto a receiver to form an image on the receiver, a method for sensing data uniquely associated with a waste material containing container loaded into the printer, the method comprising the steps of:

(a) operating a transceiver to transmit a first electromagnetic field, the first electromagnetic field including a code providing a command to read or write data; and (b) providing a transponder associated with the container, the transponder including a memory, the transponder receiving the first electromagnetic field and generating a second electromagnetic field in response to the code in the first electromagnetic field that provides a command to read data from the memory, the second electromagnetic field carrying information relative to data stored in the memory, the memory being coupled to the transponder and having the data stored therein and uniquely associated with the waste material in the container, and the transponder in response to a code providing a command to write data provides a signal to the memory to apply information from the first electromagnetic field into the memory.

26. The printer of claim 25, wherein the first electromagnetic field includes data regarding a current level of waste material in the container and the current level of waste material in the container is written into the memory.

27. In a printer which operates to selectively deposit ink onto a receiver to form an image on the receiver, a method for sensing data uniquely associated with an ink consumable loaded into the printer, the method comprising the steps of:

(a) operating a transceiver to transmit a first electromagnetic field, the first electromagnetic field including a code providing a command to read or write data; and (b) providing a transponder associated with the ink consumable, the transponder receiving the first electromagnetic field and generating a second electromagnetic field in response to the code in the first electromagnetic field providing a command to read data from a memory, the second electromagnetic field carrying information relative to data stored in the memory, the memory being coupled to the transponder and having the data stored therein and uniquely associated with the ink consumable, and the transponder in response to a code providing a command to write data provides a signal to the memory to apply information from the first electromagnetic field into the memory, and wherein the transceiver is blocked from overwriting of certain stored data in the memory.

28. The method of claim 27, and wherein the transponder receives energy from the first electromagnetic field as the only energy for powering the transponder.

29. The method of claim 28, wherein a device associated with the consumable has a sensing mechanism, and the sensing mechanism accurately indicates the amount of consumable used or remaining and this amount is stored in the memory.

30. The method of claim 28, wherein the transceiver communicates with the transponder without making touching contact with the transponder.

31. The method of claim 28, wherein the memory is a non-volatile semiconductor memory that is integrally contained in the transponder.

32. The method of claim 28, wherein the transceiver senses the second electromagnetic field and extracts the data content for subsequent processing in operating the printer.

33. The method of claim 28, wherein the transceiver addresses the transponder to write data to the memory associated with the consumable and wherein the data is indicative of usage of the consumable.

34. The method of claim 28, wherein in response to the information carried by the second electromagnetic field a control logic in the printer determines the type of consumable that is loaded in the printer.

35. The method of claim 34, wherein the control logic determines manufacturing date and batch number from the information carried by the second electromagnetic field.

36. The method of claim 28, wherein the memory stores calibration data relative to the consumable.

37. The method of claim 28, wherein the memory stores sensitometric data relative to the consumable.

38. The method of claim 28, wherein a determination is made as to whether or not a print job is compatible with the consumable, and if the print job is not compatible with the consumable print operation is disabled.

39. An ink container including an ink consumable for use in a printer and the container including a transponder and memory specially adapted for use in the method of claim 27 and wherein the memory is coupled to the transponder and has data stored therein and uniquely associated with a consumable used in the printer, the transponder being adapted to receive energy from the first electromagnetic field that is generated by the transceiver and the energy comprising the only energy for powering the transponder and the code indicating a read or write command for the memory, the energy being usable in accordance with a read code to generate a signal representing data stored in the memory about the consumable for sensing by the transceiver and for a write code to write information into the memory providing an update of the amount of consumable used or remaining, and the memory storing an update of the consumable used from or remaining in the container.

40. The method of claim 27, and wherein the first electromagnetic field includes data regarding a current level of ink consumable and the data regarding current level of ink consumable is written into the memory.

41. A printer of the type which selectively deposits color marking material onto a receiver sheet to form an image on the receiver sheet, the printer being adapted to sense data uniquely associated with a receiver sheet consumable loaded into the printer, the printer comprising:

(a) a transceiver for transmitting a first electromagnetic field and for sensing a second and electromagnetic field, the first electromagnetic field containing data for writing into a memory associated with the receiver sheet consumable;

(b) a transponder coupled to a sheet-like member that is part of a stack of discrete receiver sheets loaded in the printer, the discrete receiver sheets comprising the consumable, said transponder adapted to receive the first electromagnetic field and generate the second electromagnetic field in response to the first electromagnetic field received thereby, the transponder adapted to receive the energy from the first electromagnetic field that is generated by the transceiver and the energy comprising the only energy for powering the transponder and the transponder being adapted to read data from the memory; and (c) the memory associated with the receiver sheet consumable, the memory being coupled to said transponder, said memory having data stored therein uniquely associated with the receiver sheet consumable, whereby the second electromagnetic field carries the data stored in said memory while the second electromagnetic field is generated, the second electromagnetic field being characteristic of the data stored in said memory.

* * * * *